United States Patent [19]

Hillis

[11] Patent Number: 4,468,305

[45] Date of Patent: Aug. 28, 1984

[54] METHOD FOR THE ELECTROLYTIC REGENERATION OF ETCHANTS FOR METALS

[75] Inventor: Maurice R. Hillis, Chester, England

[73] Assignee: The Electricity Council, London, England

[21] Appl. No.: 145,948

[22] Filed: May 2, 1980

[30] Foreign Application Priority Data

May 8, 1979 [GB] United Kingdom ..... 7915899

[51] Int. Cl.[3] ..... C25F 5/00; C25F 7/02

[52] U.S. Cl. ..... 204/130; 204/151

[58] Field of Search ..... 204/130, 106, 103, 151, 204/275, 301

[56] References Cited

U.S. PATENT DOCUMENTS

| | | | |
|---|---|---|---|
| 2,748,071 | 5/1956 | Eisler | 204/130 |
| 3,615,957 | 10/1971 | Konstantouros | 204/106 |
| 3,761,369 | 9/1973 | Tirrell | 204/151 |
| 3,764,503 | 10/1973 | Lancy | 204/151 |
| 4,051,001 | 9/1977 | Inoue et al. | 204/151 |

FOREIGN PATENT DOCUMENTS

| | | |
|---|---|---|
| 213191 | 1/1961 | Australia . |
| 2008766 | 7/1971 | Fed. Rep. of Germany . |
| 2241462 | 3/1974 | Fed. Rep. of Germany . |
| 2537757 | 3/1976 | Fed. Rep. of Germany . |
| 2641905 | 3/1978 | Fed. Rep. of Germany . |
| 2650912 | 5/1978 | Fed. Rep. of Germany . |
| 52-32579 | 11/1977 | Japan . |
| 52-32580 | 11/1977 | Japan . |
| 1151943 | 5/1969 | United Kingdom . |
| 1141407 | 9/1969 | United Kingdom . |
| 1362601 | 8/1974 | United Kingdom . |
| 1391893 | 4/1975 | United Kingdom . |
| 1485605 | 9/1977 | United Kingdom . |
| 1507324 | 4/1978 | United Kingdom . |

*Primary Examiner*—Thomas Tufariello

*Attorney, Agent, or Firm*—Beveridge, DeGrandi & Kline

[57] ABSTRACT

A method of regenerating a spent metal etchant solution and the metal which has been etched therewith, comprising circulating the spent etchant solution between an etching vessel and the anode compartment of an electrolytic cell provided with a cell divider, for example an anion or cation exchange membrane defining the said anode compartment and a cathode compartment, and electrolytically re-oxidizing the reduced etchant in the cell to regenerate the etchant in the anode compartment and the etched metal in the cathode compartment while introducing a portion of the circulating etchant solution into the cathode compartment, for example by pumping solution from the etching vessel, or by gravity, the said portion being sufficiently small as not to raise the level of etchant in the cathode compartment to a level which will prevent the said electrolytic reduction of ions of the etched metal.

13 Claims, 2 Drawing Figures

METHOD FOR THE ELECTROLYTIC REGENERATION OF ETCHANTS FOR METALS

Figure 1:
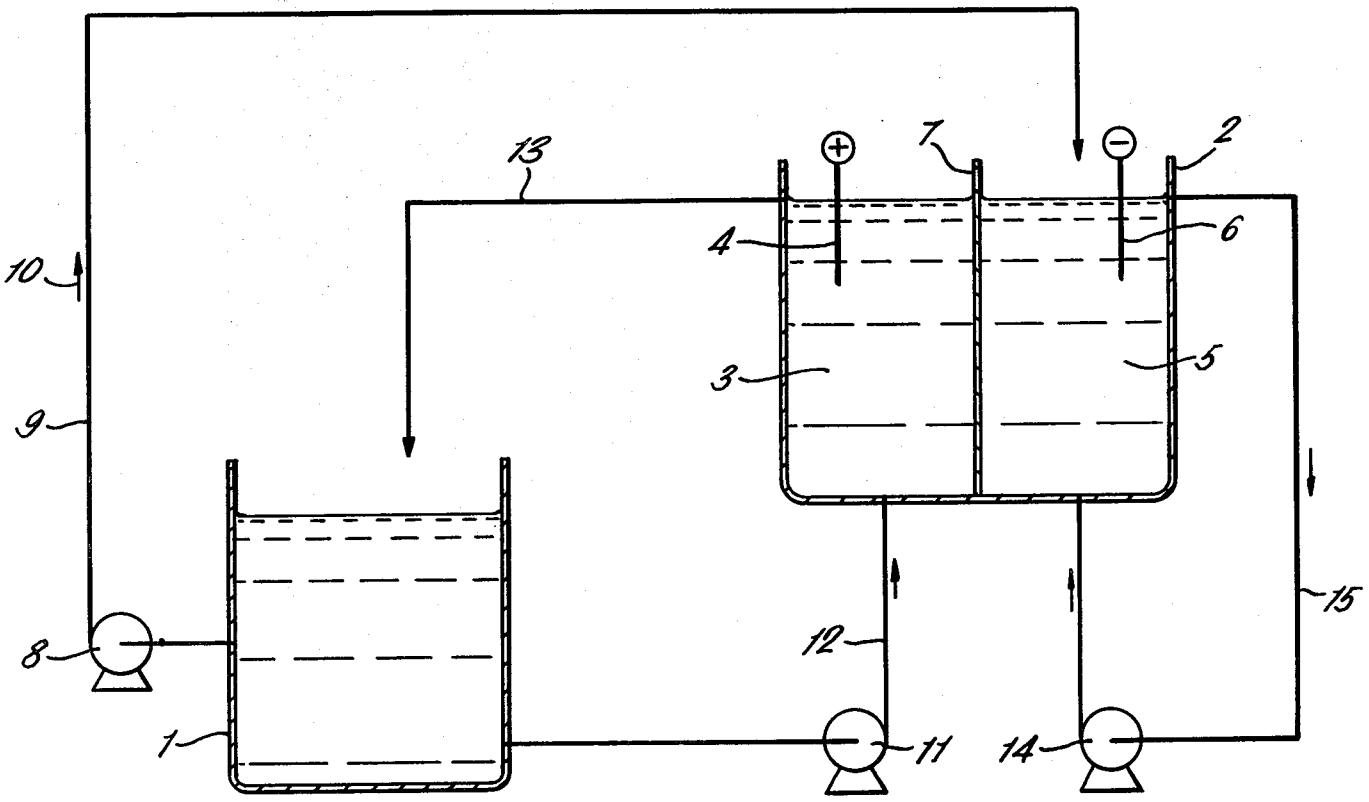

This invention relates to the etching of metals with etchant solutions, and in particular to the regeneration of such solutions after the etching process.

The etching of metals is carried out in a large number of industrial processes, both for the cleaning of metal surfaces, and in order to provide a desired pattern on a metal surface. An example of the application of the latter technique is in the production of so-called "printed circuits" in which a layer of copper on an insulating substrate is etched away in predetermined areas, in order to provide a desired pattern of conducting links on the surface of the insulating substrate.

Etchants commonly used in the production of printed circuits include aqueous ferric chloride solution ($FeCl_3$) and aqueous cupric chloride solution ($CuCl_2$). The species responsible for the etching of the metal may be considered to be the metal ion (in the two above examples $Fe^{III}$ and $Cu^{II}$ respectively), which becomes reduced during the etching process (in the two examples to $Fe^{II}$ and $Cu^{I}$ respectively).

As the etching process continues, the concentration of reduced etchant (e.g. $Fe^{II}$ and $Cu^{I}$) in the etchant solution increases, and thus the solution becomes "spent". Of course, "spent" etchant may still contain significant concentrations of the etchant in the oxidised state, and thus may still be effective for etching the metal in question, although in general the efficiency of etching will be low. It should be understood that the term "spent etchant" as used herein includes solution containing substantial concentrations of effective etchant (i.e. etchant in the oxidised state).

The disposal of spent etchant solution is a significant problem when etching is carried out on a large scale, and can often be a significant industrial cost.

The invention provides a method of regenerating a spent metal etchant solution and the metal which has been etched therewith, utilising an electrolytic cell provided with a cell divider to define an anode compartment and a cathode compartment, which method comprises circulating the spent etchant solution between an etching vessel and the said anode compartment, the spent etchant thus constituting the cell anolyte, the cathode compartment containing a catholyte solution comprising ions of the etched metal, and electrolytically re-oxidising in the cell reduced etchant present in the anolyte solution to regenerate the etchant in the anode compartment, the said metal being electrolytically regenerated in the cathode compartment, the concentration of ions of the etched metal in the catholyte being maintained by continuously or intermittently introducing into it an appropriate small quantity of the circulating spent etchant solution, the said quantity being such that the concentration of etchant in the catholyte is not sufficiently high as to prevent the electrolytic reduction of ions of the etched metal.

The method of the invention is particularly suitable for use on a continuous basis, and is thus particularly suited for adaptation to a production line.

In the present invention, the cell divider need operate only as a means of slowing diffusion of ions between the anode and cathode compartments, in order to enable the necessary concentrations of etchant and reduced etchant in the compartments at the appropriate level. Thus, a material having an equal resistance to the passage of ions of all types may be used, for example asbestos or a similar material. However, it is generally preferred that the cell divider should be of an anion or cation exchange membrane.

In order to obtain maximum output from a given cell, it is generally desirable to use as high a current density as is possible but unless the permeability of the cell divider to the diffusing ions exactly matches the desired rate of operation, an imbalance can arise, as a result of which either the cathode compartment becomes depleted of ions of the etched metal, or the cell divider is ineffective. In practice therefore the cell is operated using a divider having a permeability to ions of the etched metal which is relatively low, in comparison to the amount of etched metal which the desired current density is capable of reducing, the concentration of ions of the etched metal in the cathode compartment is supplemented by intermittently or continuously introducing etchant solution containing ions of the etched metal into the cathode compartment. In order that the concentration of unreduced etchant in the cathode compartment does not become so high as to prevent the deposition of the metal in the cathode compartment, the amounts of such solution must be maintained quite small. A simple overflow arrangement can be provided, in order to prevent overfilling of the cathode compartment, although such an arrangement may not be necessary because of evaporation.

The transfer of such amounts of spent etchant solution containing ions of the etched metal can be provided by means of an etchant transfer pump, and suitable pipe work, arranged so as to pump solution either from the etching vessel, or the anode compartment, into the cathode compartment, when the pump is in operation.

Preferably, however a simple bleed line may be provided to transfer solution from the anode to the cathode compartment under gravity, or utilising an existing pressure differential at the respective points of connection of the bleed line.

Whichever arrangement is used for transfer of solution containing the etched metal ions, a valve will normally be incorporated so that the appropriate transfer rate can be achieved. This valve may be manually operated, the operator keeping a careful watch of the metal ion concentration in the cathode compartment, and adjusting the valve when necessary. Alternatively the apparatus may be automated so as to provide means responsive to the concentration of etched metal ions in the cathode compartment arranged so as to control the transfer rate. For example, the optical density of the catholyte may be used as a measure of the etched metal ion concentration, and a signal responsive to the optical density used to control a transfer pump or a bleed valve so as to maintain the etched metal ion concentration within desired limits.

The desired range of concentration of ions of the etched metal in the catholyte will be determined largely by the metal etchant system under consideration and the mass transfer condition in the cell. When the metal deposited at the cathode is copper (e.g. in the $Cu/CuCl_2$ system for which the method of the invention is particularly useful), it is most desirable that the copper produced at the cathode is in the dendritic form, since in this form it readily sloughs off the cathode and collects at the bottom of the cathode compartment, from where it can be removed without the need to withdraw the cathode. As is wellknown the metal will deposit in this form only under certain concentration conditions for a given current density. The concentration of ions of etched metal should in this case be such as to give the desired dendritic deposit at the current density adopted.

An additional constraint on the lower level of concentration is that it should preferably not be allowed to become so low that the next most favoured electrochemical reaction at the cathode (usually discharge of $H^+$ to give hydrogen gas) occurs to a significant extent. We have found that, for the particular cell arrangement described hereafter using a current density of approximately 35 A/dm$^2$, a concentration of $Cu^+$ of from 2 to 60 g/l, preferably from 10 to 20 g/l is very suitable.

The solution containing ions of the etched metal which is introduced into the cathode compartment will also contain (unreduced) etchant (e.g. in the $CuCl_2$ system, $Cu^{II}$ ions), and since the etchant must necessarily be discharged more readily at a negative electrode than an ion of the metal which it is used to etch, the small amount of etchant introduced in the transfer operation will be reduced (in the above case $Cu^{II} \rightarrow Cu^{I}$) before plating of copper takes place.

The method of the invention has been particularly successful when the etchant in use is a salt of the metal which is being etched, e.g. when a salt of copper, such as $CuCl_2$ or a complex cuprammine is used to etch Copper of ferric chloride is used to etch iron or steel. In such a case, when the etchant introduced into the cathode compartment is reduced, the ions produced ($Cu^{I}$ or $Fe^{II}$ respectively) can be further reduced to the metal.

When complex cuprammines are used as the etchant, some re-oxidisation may take place under the action of aerial oxygen, so that only a portion of the etchant reoxidation need be carried out electrolytically.

The prime concern of the user of the apparatus will normally be the regeneration of etchant, and not the recovery of the etched metal, since the former affects production costs directly by lowering raw material costs (e.g. etchant, or chemicals for regenerating the etchant) and waste disposal costs. The operating conditions of the cell will therefore normally be arranged so as to give optimum current efficiency for the anode reaction, the etched metal concentration in the catholyte being adjusted, appropriately as described above.

The spent etchant solution is preferably circulated between the etching vessel and the anode compartment by means of an anolyte circulation pump, and it is generally desirable that a continuous flow of the solution should be provided over the anode, in order to minimise concentration gradients within the anode compartment. Similarly, the cathode compartment is preferably provided with a catholyte circulation pump, arranged so as to cause a continuous flow of catholyte over the surface of the cathode.

The direction of circulation in the anode compartment is of no great consequence, but it has been found preferable to arrange for flow over the cathode to take place in a generally downward direction, since this tends to assist settling of any fine metal particles produced.

Either or both of the anolyte or catholyte circulation systems may include a reservoir for the solution (which may be open to the atmosphere), so as to increase its effective volume. When downward pumping of the catholyte is employed, any catholyte reservoir employed will not normally be open to the atmosphere.

The method of the invention may be utilised with a wide range of compositions of etchant solution (anolyte). Because the etchant is continuously regenerated, it is not necessary to allow the etched metal concentration in the etchant to become high, as is frequently done in prior art systems.

Although there is no particular limitation on the type of cell which may be used, it has been found generally convenient to use a cell having multiple compartments, for example a central cathode compartment and two outer anode compartments, or a five compartment cell, with alternate anode and cathode compartments, the central one being an anode compartment.

In such cells including more than a single cathode compartment, the cathode compartments are preferably joined at their bases into a large storage volume for the regenerated metal, such that the cell may be operated for a substantial period before it becomes necessary to drain down the cell to remove the accumulated regenerated metal.

The industrial etching process may in practice be intermittent, and it may therefore be desirable to provide means for sensing when substantially all the spent etchant in the anolyte has been regenerated, so that the cell can be shut down. If electrolysis continues beyond this point, the next anode reaction (which in a cupric chloride or ferric chloride etchant is chlorine evolution) will set in. This end point can be effectively monitored by measuring the redox potential of the anolyte, and, if desired, utilising the measured potential to automatically switch off the power supply to the electrolytic cell. For example, when a cupric chloride etchant is used, the power supply could be shut off when the redox potential of the anolyte rises to, say, 950 m.V. and brought in again when the redox potential falls to, say, 700 m.V. These potentials are, of course, merely illustrative.

There is no particular limitation on the current density which may be employed in the method of the invention. A current density of 35 A/dm$^2$ has been found effective, although, with some loss in current efficiency, the current density may be raised to as high as (100 A/dm$^2$.

Figure 2:
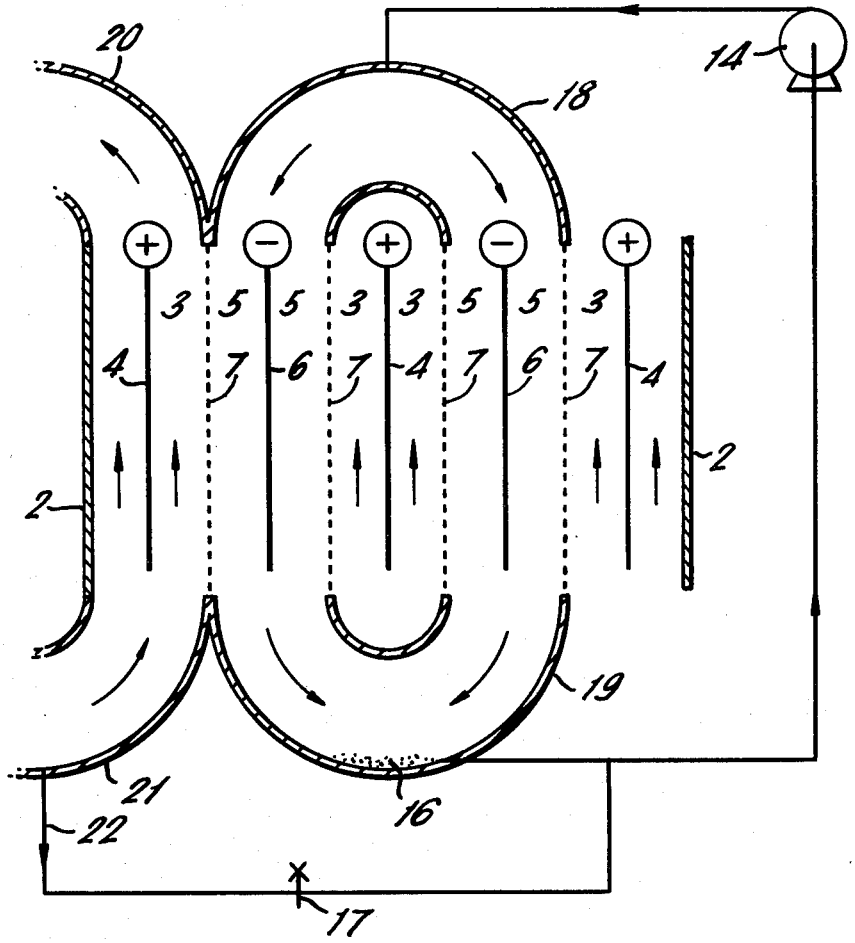

A preferred embodiment of the invention will now be described with reference to the accompanying drawings in which:

FIG. 1 is a schematic drawing of apparatus according to an embodiment of the invention, and FIG. 2 is a schematic drawing of a part of an alternative embodiment of apparatus according to the invention.

In the drawings, like reference numerals refer to like parts.

The apparatus of FIG. 1 comprises an etching tank 1 and electrolytic cell 2, which is divided by a cell divider 7 into an anode compartment 3 and cathode compartment 5. An anolyte circulation pump 11 provides, when in operation, a continuous circulation of spent etchant solution (anolyte) over the surface of anode 4, via conduits 12 and 13. Similarly, a catholyte circulation pump, 14, provides a continuous circulation of catholyte over cathode 6 via conduit 15.

An etchant transfer pump 8, when in operation, provides for the continuous transfer of a relatively small amount of etchant solution from the etching vessel 1 to the cathode compartment 5, via conduit 9, in the direction of the arrow 10. Excess liquid in the cathode compartment returns to the etching tank by means of an overflow (not shown).

FIG. 2 shows a schematic diagram of an electrolytic cell and associated catholyte system. The electrolytic cell has a plurality of anode 3 and a plurality of cathode compartments 5, containing associated anodes 4 and cathodes 6. Adjacent anode and adjacent cathode compartments are linked so as to form, in effect, a single compartment.

Catholyte is pumped downwardly through the cathode compartments via inlet manifold 18 and leaves through outlet manifold 19. Circulation is effected by pump 14. Similar manifolds are provided linking the anode compartments, but only one branch of each, 20 and 21 is shown, for clarity.

Copper deposited in the cathode compartments collects in their connected base portions at 16.

Etchant transferred from the solution circulating through the anode compartments to that circulating through the cathode compartments is provided by bleed line 22, provided with control valve 17. Solution flows through line 22 in the direction of the arrow, because of the differences in pressure at the points of connection to the respective halves of the system, due to the circulating pumps.

The invention is illustrated by the following examples.

EXAMPLE 1

The apparatus used was as shown schematically in FIG. 1. The volume of the anode compartment was 1 liter, and that of the cathode compartment 2.5 liters. The cell Divider 7 was a commercially available cation exchange membrane, sold under the trade mark NAFION.

The conduit 15 included a cathode reservoir, so that the total volume of catholyte was 4 liters. The circulation rate of the catholyte in conduit 15 was between 0.5 and 1 liter per minute. The total volume of anolyte was 10 liters, and this was circulated through conduits 12 and 13 at a rate of from 5 to 10 liters per minute.

The membrane, anode, and cathode were each 77 $cm_2$ in area. The anode was made of graphite, and the cathode of titanium.

The etchant used was $Cu_{II}$, in the form of $CuCl_2$. Copper was introduced into the etching vessel 1 at a rate of approximately 650 grams per day, and was dissolved by the cupric chloride solution to produce ions of the etched metal ($Cu^I$) and ions of reduced etchant (in this example, the reduced etchant is also $Cu^I$, since the etchant cation is the cation of the metal being etched).

A current of from 25 to 30 amps was passed between the anode and cathode, requiring a voltage of from 7 to 9 volts, from a DC source (not shown).

The cation exchange membrane did not allow the passage of sufficient copper ions for the plating in the cathode compartment of the required amount of copper, and so a small quantity of spent etchant solution was passed via the pump 8 and conduit 9 from the etching vessel into the cathode compartment. This rate was approximately 3 mls per minute. Excess solution in the cathode compartment was allowed to overflow and return to the bulk of the liquid, in the anode compartment.

Approximately 24 hours from the time at which electrolysis was commenced, substantially all of the $Cu^I$ had been oxidised in the anode compartment to $Cu^{II}$. This could be seen by the change in colour to bright green, and by the redox potential, which exceeded 800 mV. Copper was plated onto the surface of the cathode in a dendritic form and most of the deposited copper dropped off the cathode to the bottom of the cathode compartment, from where it was easily removed. The redissolution of copper was avoided, since the level of $Cu^{II}$ in the cathode compartment was kept low by electrolysis. The concentration of copper in the anolyte was between 100 and 130 g/l, usually about 120 g/l. The copper concentration in the catholyte was approximately 10 to 20 g/l, although we have found that the process is effective with catholyte copper concentrations of from 2 to 70 g/l.

During the process, the temperature of the solutions was in the range from 35° to 40° C., and the free hydrochloric acid level in the anolyte was maintained at about 60 g/l, by the addition of about 600 mls of concentrated HCl per day. Such addition was possible without increasing the volume of the etchant, due to evaporative losses, and indeed about 1 liter of water was necessary in addition, in order to fully compensate for evaporation.

Over a period of continuous operation, the efficiency of copper removal of the arrangement was from 0.65 to 1.2 g per Ah.

EXAMPLE II

A 2000 A cell was constructed generally in accordance with FIG. 2, and was found to be capable of recovering 2 kg of copper per hour while regenerating the equivalent volume of cupric chloride etchant. The cathode, anode, and separator materials were as in Example I.

Flow through anode compartments — 70 liters/min
Flow through cathode compartments — 60 liters/min
Anolyte copper concentration — 120–150 g/l
Anolyte free hydrochloric acid concentration — 100–160 g/l
Catholyte copper concentration — 10–20 g/l Temperature of anolyte and catholyte — 50°

EXAMPLE III

A cell as described in Example II was used to regenerate a $CuCl_2$ etchant, a current of 3000 A produced 3 Kg of copper per hour, the flow through the anode compartments being 220 liters/min, and that through the cathode compartment 80 liters/min, other conditions were as in Example II.

EXAMPLE IV

A similar apparatus to that used in Example III was used to regenerate Ferric chloride from an etchant used in the pickling of steel.

The spent etchant had a composition of 20–50 g/l $Fe^{++}$ and 80–120 g/l $Fe^{+++}$ which was converted to completely ferric at a rate of 2.65 g/Ah. The temperature was 40° C. and the catholyte composition was controlled to 10–20 g/l $Fe^{++}$.

I claim:

1. A method of regenerating a spent metal etchant solution and the metal which has been etched therewith, utilising an electrolytic cell provided with a cell divider to define an anode compartment and a cathode compartment, which method comprises circulating the spent etchant solution between an etching vessel and the said anode compartment, the spent etchant thus constituting the cell anolyte, the cathode compartment containing a catholyte solution comprising ions of the etched metal and no more than an insignificant amount of unreduced etchant and electrolytically re-oxidising in the cell reduced etchant present in the anolyte solution to regenerate the etchant in the anode compartment, the said metal being electrolytically regenerated in the cathode compartment, the concentration of ions of the etched metal in the catholyte being maintained by continuously or intermittently introducing into it an appropriate small quantity of the solution circulating between the anode compartment and the etching tank, the said quantity being such that the concentration of unreduced etchant in the catholyte is not sufficiently high as to prevent the electrolytic reduction of ions of the etched metal.

2. A method as claimed in claim 1, wherein a quantity of solution is caused to return to the bulk of the etchant solution to prevent overfilling of the cathode compartment.

3. A method as claimed in claim 1, wherein the said small quantity of circulating etchant introduced into the catholyte is so introduced by means of a bleed line incorporating a valve.

4. A method as claimed in claim 1, wherein the circulation of the spent etchant solution through the anode compartment is carried out by means of an anolyte circulation pump arranged to provide continuous recirculation between the anode compartment and an etching vessel.

5. A method as claimed in claim 4, wherein the flow from the anolyte circulation pump is arranged so as to provide a continuous flow of the solution over the surface of the anode.

6. A method as claimed in claim 1, wherein the catholyte is caused to flow continuously over the surface of the cathode, by means of a catholyte circulation pump.

7. A method as claimed in claim 6, wherein the flow over the cathode is in a generally downward direction.

8. A method as claimed in claim 1, wherein the cell divider is an anion or cation exchange membrane.

9. A method as claimed in claim 1, wherein the etched metal is copper.

10. A method as claimed in claim 9, wherein the etchant comprises $Cu^{II}$ or $Fe^{III}$.

11. A method as claimed in claim 10, wherein the etchant solution comprises chloride ions.

12. A method as claimed in claim 1, wherein the etchant is a salt of the metal being etched, whereby ions of the etched metal are also ions of spent etchant.

13. A method of regenerating a spent cupric chloride etchant solution and copper which has been etched therewith, utilising an electrolytic cell provided with a cell divider to define an anode compartment and a cathode compartment, which method comprises circulating the spent etchant solution between an etching vessel and the said anode compartment, the spent etchant thus constituting the cell anolyte, the cathode compartment containing a catholyte solution comprising cuprous ions and no more than an insignificant quantity of cupric ions and electrolytically reoxidising in the cell cuprous ions present in the anolyte solution to regenerate cupric ions in the anode compartment, copper being electrolytically regenerated in the cathode compartment, the concentration of cuprous ions in the catholyte being maintained by continuously or intermittently introducing into it an appropriate small quantity of the solution circulating between the anode compartment and the etching tank, the said quantity being such that the concentration of cupric ions in the catholyte is not sufficiently high as to prevent the electrolytic reduction of the cuprous ions.

* * * * *